United States Patent [19]

Gerhard

[11] 4,315,531

[45] Feb. 16, 1982

[54] TRANSPORT CONTAINER

[75] Inventor: Helmut Gerhard, Weitefeld, Fed. Rep. of Germany

[73] Assignee: Westerwalder Eisenwerk Gerhard GmbH, Fed. Rep. of Germany

[21] Appl. No.: 42,552

[22] Filed: May 25, 1979

Related U.S. Application Data

[63] Continuation-in-part of Ser. No. 35,812, May 4, 1979, abandoned.

[30] Foreign Application Priority Data

May 6, 1978 [DE] Fed. Rep. of Germany ..... 2819955

[51] Int. Cl.[3] ..... B65B 3/04; B65D 90/10

[52] U.S. Cl. ..... 141/98; 137/590; 141/113; 220/1 B; 220/5 A

[58] Field of Search ..... 105/358, 360; 137/590; 141/35, 98, 113, 325, 326, 392; 220/1 B, 5 A; 222/185

[56] References Cited

U.S. PATENT DOCUMENTS

| | | | |
|---|---|---|---|
| 3,730,384 | 5/1973 | Ramme | 220/1 B X |
| 3,782,416 | 1/1974 | Levin | 137/590 |
| 3,814,290 | 6/1974 | Gerhard | 220/5 A X |
| 3,906,995 | 9/1975 | Schmidt | 141/35 X |

*Primary Examiner*—Frederick R. Schmidt
*Attorney, Agent, or Firm*—Craig and Antonelli

[57] ABSTRACT

A transport container of the type made from cylindrical shells for use in the combined handling of liquids gases or loose material. The transport container is designed for emptying under pressure or by gravity, with connections for fixtures wherein stresses in the region of the connections are reduced.

41 Claims, 12 Drawing Figures

TRANSPORT CONTAINER

BACKGROUND AND SUMMARY OF THE INVENTION

This application is a continuation-in-part application of my earlier U.S. application Ser. No. 035,812, filed May 4, 1979 and titled: A TRANSPORT CONTAINER FOR LIQUIDS, GASES AND LOOSE MATERIAL, now abandoned.

The invention relates to a transport container of the type made from cylindrical shells for use in the combined handling of liquids, gases or loose material. The term loose material refers to dry bulk flowable material, including granular and powdered substances. The invention is particularly directed to transport containers of the aforementioned type which are designed for emptying under pressure or by gravity, and which have connections for fixtures. The present invention is particularly concerned with improving transport or freight containers for intermodal carriage of liquids, gases, and dry bulk, which meet the size and design requirements of the International Standardizing Organization (ISO). Since ISO standards limit the overall height and width of such freight containers, one purpose of the present invention is to optimize the net freight carrying capacity of such freight containers given the size restraints, while also minimizing the manufacturing costs and maximizing the in-use reliability and performance of same.

According to the dangerous character of the load, transport containers of the type contemplated are emptied either by pressure higher than the atmospheric pressure through a riser built in the top of the container, or the gravity through a discharge value built in the bottom of the container. In order to ensure emptying which is as complete as possible, in both cases a depression (sump) must be formed in the bottom of the container where the remaining material/liquid can accumulate.

Various embodiments of such sumps are known, including sump basins. Due to the necessary metal deformation during manufacture, prior sump basin constructions cause structural changes in the material of the container. This is especially so with containers made mostly from alloyed steel so that weakening of the wall occurs due to the straining of the sheet metal.

In order to avoid this disadvantage block flanges are welded into a corresponding recess in the bottom of the container. These require large cross-sections and the considerable differences in thickness between the material of the flange and the container wall cause corresponding transition stresses.

U-shaped troughs or semi-tubular shells welded into the bottom, which may extend either longitudinally or transversely, require a considerable amount of welding and large holes in the wall with corresponding loss of material. In addition they have a disadvantageous shape as regards pressure stresses experienced in use.

In the mentioned prior constructions additional guides are needed for the riser fixed in the top of the container, in order to retain the riser in the prescribed position ending in the sump and protect it against vibration.

Also, open troughs, partly composed of semitubular shells and partly of sheet metal bottom and sidewalls, have been welded into the container. It is also known to build in sump units without outlet. Edge stresses cannot be contained by these shells without the danger of bulging.

In order to meet all the requirements, particularly when the load varies, and to ensure complete emptying of the sump, which is inaccessible, particularly for cleaning, it is recommended to make the sump as a discharge spout closed by a bottom valve. In that case either the riser may be used for emptying under pressure of the bottom valve may be used for emptying by gravity. Even this arrangement suffers from the disadvantages mentioned earlier.

Also further fixtures must be provided in the transport container in addition to the mentioned riser for emptying of the container. These include, in addition to a manhole, e.g. relief pressure valves, fuses, bursting discs and also connections for pressurized air and inert gases.

These fixtures are usually arranged at the top of the container. Due to the structural height of these elements required by their function, a part of the structural height of the container which is valuable for obtaining optimum loading space is lost thereby as a rule.

In addition it has been repeatedly shown that fixtures welded on the outer wall of the container shell cause leakage of the container contents when they are sheared or torn off the container during an accident. To provide protection against fire and explosion, and also for health and environmental protection, leaks caused in this way must be reduced to an absolute minimum.

Attempts have already been made to protect the fixtures in the top of the container by the provision of protective frames, covers or rub rails extending in longitudinal directions. These protective means often considerably increase the dead weight of the container and also increase, not insubstantially, expenses caused by the additional work involved. Also the provision of protective frames fixed to the wall of the container means increased danger in an accident; because of the increased stress concentration and contraction strains, cracking of the container wall may occur.

In order to avoid these losses in the structural height and the dangers in case of an accident, fixtures were built into the container wall horizontally. The oval cutouts in the container wall, needed for this purpose, are however undesirable in view of the pressures acting on the container. In addition, many calculation codes require also additional reinforcing collars, which result in additional expenses for material and welding.

It may be stated in general that when pipe sections of circular, elliptical or oval cross-section are inserted into the container wall, edge stresses are transmitted to them, which would otherwise be contained by the portion cutout from the cylindrical shell.

The object of the present invention is therefore, with the maximization of the diameter, cross-sectional area and volume of the container, to provide a height-saving arrangement of the connection elements for emptying and filling the container and of various further fixtures, in which the stresses and the deterioration of structures of the container and the welds are held to a minimum. This is achieved according to the invention by providing a transport container, made from cylindrical shells for combined handling of liquids, gases or loose material, adapted for emptying under pressure or by gravity, and/or having connections for fixtures, characterized in that one or a plurality of pipes are welded into the container bottom and/or into the top of the container, said pipes having a cross-section being circular, elliptical or oval whereby about half of the pipe portions extend above the container top and about half below the container bottom respectively, and carry connections for fixtures.

In particularly preferred embodiments of the invention, a pipe member is provided at the bottom of the horizontally extending cylindrical shell, which bottom pipe member has a major portion of its cross-sectional height disposed inside of the cylindrical shell to accommodate firm guiding and retention of a riser tube for emptying the container under pressure. In practical, most preferred embodiments, between one half ($\frac{1}{2}$) and two thirds ($\frac{2}{3}$) and at most two thirds ($\frac{2}{3}$) of the cross-sectional height of the bottom tube member is disposed inside the cylindrical shell with the remainder protruding downwardly below the bottom of the cylindrical shell to accommodate connection of discharge fixtures or the like.

In further preferred embodiments of the invention, a pipe member is provided at the top of a horizontally extending cylindrical shell, which top pipe member has a major portion of its cross-section located above and outside the cylindrical shell to carry connections for fixtures. In practical most preferred embodiments, between one half ($\frac{1}{2}$) and two thirds ($\frac{2}{3}$) and at most two thirds ($\frac{2}{3}$) of the cross-sectional height of the top tube member is disposed above and outside the cylindrical shell, to thereby optimize utilization of the top tube member for carrying fixture connections.

An advantageous embodiment of the invention is achieved in that the discharge spout is formed by a pipe section at least one end of which is open and which is inserted into the container bottom either parallel or at an acute angle to the horizontal, the top of said pipe section being provided with an opening for guiding the riser, the outlet end of said pipe section ending in a connection flange. In preferred embodiments, a pipe is welded into the top of the container to extend parallel to the top line of the container, the top of the pipe extending laterally above the container and the upper half of the pipe having at least one connection opening which is accessible from outside and which is not vertical.

By the use of pipe members for the mounting of the riser and for the fixing of the fixtures, bridge regions remain to the inside of the container in contrast to the use of troughs open at one side. Stresses and worsening of the structure of the steel in the region of the welds is therefore reduced and with it also the danger of bulging out of the container in the region of the welds. This leads, in addition, to the reduction of expenses for material and to a large extend also of expenses for welding. Also, the following advantages are obtained according to certain preferred embodiments of the invention: (i) the bottom discharge and the sump for the riser are united in one place; (ii) the pressure resistance of the container cross-section is largely uninfluenced; (iii) an additional welded-in holder for the riser is not needed because the riser is guided in the discharge spout pipe member; (iv) openings in the bottom of the container leading out have the smallest possible diameter; (v) the cleaning of the open discharge spout does not bring about any difficulties; and (vi) the capacity of the sump basin is very small.

The pipe members constructed according to the invention for the arrangement of the connections of the fixtures has a much smaller radius than the cylindrical shell or container. Particularly, preferred practical embodiments of the invention are constructed as transcontainers or freight containers having corner fittings to accommodate stacking with and dimensioned to conform to the standard ISO sizes which require a maximum width of eight (8) feet, a maximum height of either eight (8) feet or $8\frac{1}{2}$ feet. ISO standard lengths in the axial direction of the cylindrical shell are predominately 20 feet or 40 feet. In order to fit into the ISO standard width and height constraints, the practical embodiments have a cylindrical shell with a diameter of a little less than eight feet while the diameter of the pipe members is on the order of two to five inches. In preferred embodiments having a bottom pipe member welded into the shell wall to accommodate holding of a riser tube, the diameter of the riser tube is slightly smaller than the diameter of the bottom pipe member to accommodate their mutual engagement. Due to this difference in sizes, the pipe inserted into the cylindrical container wall forms a vaulted dome-shaped elevation relative to the rest of the container wall. In view of the much smaller radius of curvature of the pipe, the wall thickness ratio for the provision of fixtures and pipe spouts is more advantageous when compared with the cylindrical shell wall of the container. That is, the smaller radius pipe member has a higher support strength for holding fixtures and the like than does a similar thickness section of the cylindrical shell wall. The shape also accommodates the fixtures better.

The danger of cracking in the area of the inserted pipe members is reduced and also stress concentrations in the container cylindrical shell wall are reduced as compared to prior arrangements. It is also contemplated in certain preferred embodiments to weld connections and spouts from both sides to the pipe member before it is mounted in position, which avoiding welding in constrained positions on the cylindrical shell wall of the container. In other words, by the use of the pipe members according to the invention, the fixtures may be mounted in a manner which is simpler as regards welding technology, more reliable as regards fatigue and requires less work compared with the present state of the art. This has the advantage that only perfectly prepared pipe members are inserted into the container wall.

Although the present invention contemplates freight container embodiments with both top and bottom pipe members, both of which exhibit many of the above-noted advantages as to maximization of container capacity, simplicity and economy of construction, and reliability in actual intended usage; the present invention also contemplates embodiments with only a top pipe member or only a bottom pipe member. In this connection, top pipe members are utilized primarily to accommodate date fitting connections that are required at the top of the cylindrical shells. On the other hand, bottom pipe members are utilized primarily to form a sump, to guide and hold a riser tube for pressure emptying, and in certain circumstances to form a discharge spout.

Particularly preferred embodiments of the invention utilize circular cylindrical pipe members welded into openings made in the cylindrical shell wall of the container. However, elliptical/oval shaped tube members are also contemplated for use in certain other preferred embodiments of the invention. Such elliptical/oval tube members preferably have a vertical height that is at least one-third of the horizontal width thereof.

The wall thickness of the pipe members contemplated for use with the present invention is preferably approximately the same as the wall thickness of the cylindrical shell in which they are welded. In this way, the increased relative strength of the smaller radius pipe members assures adequate structural strength at the connection with the cylindrical shell, even though the pipe member includes cut away portions on the inside of the cylindrical shell to communicate with the material therein. The wall thickness of the cylindrical shell depends on the pressure to be experienced in use and are primarily in the range of 3 to 6 millimeters, although for extreme pressures, thicknesses of up to 12 millimeters may be required. Particularly preferred embodiments are constructed of steel with similar material utilized for the pipe members and the cylindrical shell.

It is important to stress that, in addition to the mentioned advantages, the desired maximization of the container capacity is achieved according to the invention since the diameter of the storage container can be maximized while still providing for any necessary sump and fitting connections.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
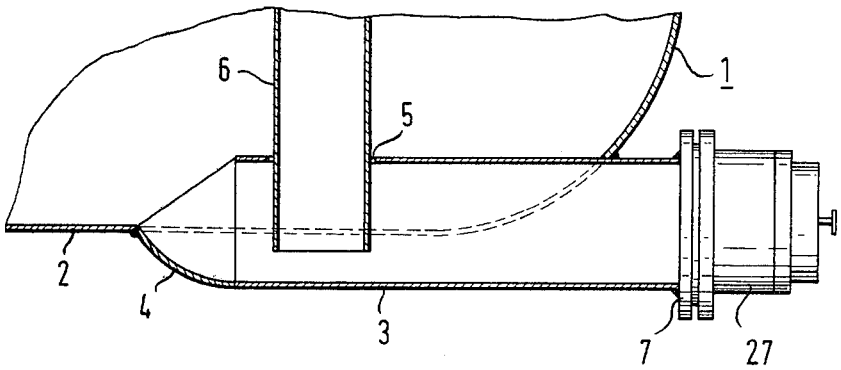
FIG. 1 is a partial sectional view through a transport container containing a first embodiment of a discharge spout constructed in accordance with the present invention.

In the embodiment shown in FIG. 1 a horizontally extending pipe member 3 is welded into the bottom 2 of a cylindrical container 1 parallel to the transverse or longitudinal axis of the container 1, in such a way that the bottom of the pipe member 3 is lower than the bottom 2 of the cylindrical shell wall of container 1. The wall thickness of the pipe member 3 is so chosen that the wall can reliably withstand any generated pressures and additional stresses caused in the relevant region by the deviation of the container wall from the membrane form. In particularly preferred embodiments with appropriate section of the diameter of pipe member 3 and the diameter of the cylindrical shell, the material and wall thickness of pipe 3 and shell 1 are the same. A transition section, which satisfies flow and pressure requirements from the container bottom 2 and the adjacent end of the pipe 3, is obtained by a segment 4 of a spherical shell.

The top of the pipe 3 is provided with an opening 5 for receiving a riser 6, the opening 5 being consequently situated vertically or obliquely below the fixtures (not illustrated) for the mounting of the riser 6 in the top of the container, so that the riser 6 may be inserted into the opening by sliding in without special retaining fixtures. In particularly preferred embodiments, the pipe member 3 has a diameter $D_p$ which is only slightly larger than the diameter $D_R$ of riser 6. In this way riser 6 can be guided and held in place by pipe 3 (opening 5 in the top of pipe 3 guides riser 6), while optimizing the size of pipe 3 as compared to the much larger diameter of the cylindrical shell container 1 (vertical height of container 1). In practical preferred embodiments the container 1 has a diameter on the order of six to eight feet, riser 6 has a diameter of about two to four inches and pipe member 3 has a diameter of between two and five inches, depending in large part on the size of the riser.

The pipe 3 forms a discharge spout which ends at its outlet end in a flange, which is situated on or outside the cylindrical shell wall of the container 1 and which may be a flat flange or a welding neck flange 7, and which serves for the connection of a discharge valve 27 of any suitable design.

Figure 2:
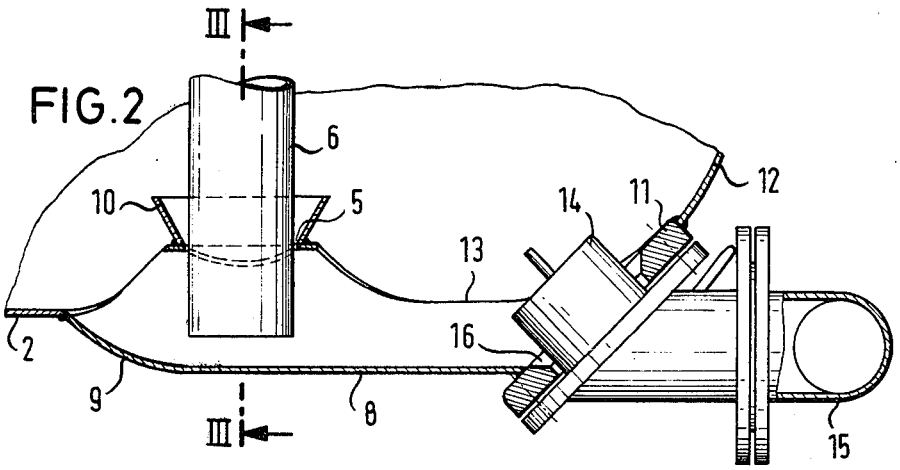
FIG. 2 is a partial longitudinal sectional view through a transport container containing a second embodiment of a discharge spout constructed in accordance with the present invention.
Figure 3:
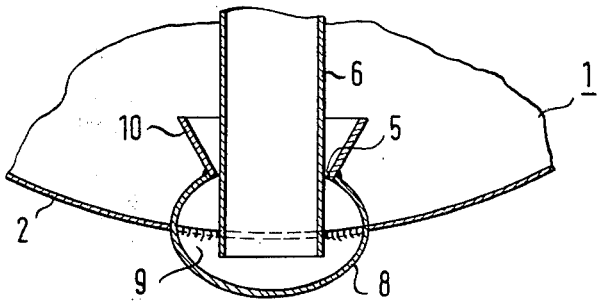
FIG. 3 is a cross-sectional view along the line III—III in FIG. 2.

In the embodiment according to FIGS. 2 and 3 the pipe member 8, which also serves as a discharge spout, is oval with a compressed cross-section. The transition between the bottom 2 of the container 1 and the pipe member 8 is in the illustrated embodiment formed by an extension 9 of the obliquely cut pipe end which is bent in the shape of a tongue, rather than by a segment of a spherical shell as in FIG. 1. In order to make insertion of the riser 6 easier, the opening 5 is on the top of the outlet pipe 8 surrounded by a diverging tapered collar 10.

The connection flange 11 for the discharge conduit is in the illustrated embodiment of FIG. 2 situated in an oblique transition area between the bottom 2 and the sidewall 12 of the container. Consequently, when viewed in horizontal direction, the circular flange 11 has an elliptic appearance. Pipe 8 is so shaped that its obliquely cut end defines an ellipse, which matches and rests on the flange 11. Next to this end the spout 8 is at its top provided with a wide recess or opening 13 which facilitates the entry and outflow of the material/liquid and so contributes to full emptying of the container. Embodiments are also contemplated having circular cross-section pipe members, otherwise similar to that shown in FIGS. 2 and 3, including an elliptic obliquely cut end of the pipe member to match a flange 11.

Inwardly opening spring-controlled valve 14 may be fitted in the closing flange 11. Various pipes, provided with a discharge valve each, may be mounted on the connection flange 11. As illustrated, a transverse pipe 15 is mounted for lateral emptying. It is, however, also contemplated to close firmly the closing flange 11 if emptying through the bottom is not required. In this way a single flange may be used in various ways according to the customer's requirements.

Figure 4:
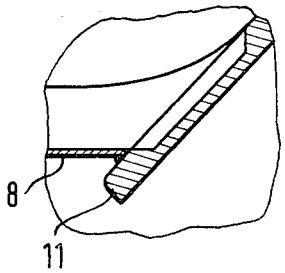
FIGS. 4 to 6 show diagrammatically various possible phases of the flange arranged according to preferred embodiments of the invention.

In Phase 1 according to FIG. 4, the flange 11 may be only partly hollowed out and consequently be fully closed. In Phase 2 according to FIG. 2 a hole 16 is made in the closing flange 11 which may be opened by means of the valve 14.

Figure 5:
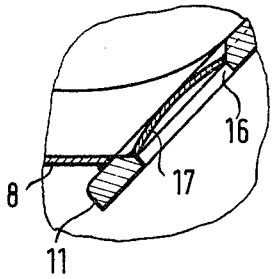
Figure 6:
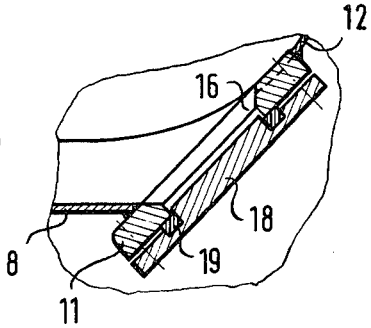

If later, in Phase 3 according to FIG. 5, the hole 16 is to be again permanently closed, this may be simply achieved by welding in it a closing disc 17. If finally, in Phase 4 according to FIG. 5, the hole 16 should serve only for cleaning or checking, it may be closed by a cover 18 connected to the flange 11 by screws or bolts, sealing 19 being interposed between the flange 11 and the cover 18.

The pipe portions remaining on both sides of the opening 5 for the riser 6, and which act as a tunnel, contain the additional tensions and stresses caused by the deviation of the container walls from the membrane form, while sudden changes of cross-section are avoided. In view of the two-sided containing of the longitudinal end edge stresses, bulging of the cylindrical walls of the container is reliably avoided.

Forces which are caused by the inner pressure and which act transversely to the pipe, are received by the oval cross-section of the pipe 8 according to the second embodiment better than by the circular cross-section pipe 3 at otherwise the same trough depth, or at the same pipe width the depth is smaller. The oval shape allows further substantial shortening of the pipe cutout on the top of the discharge spout section of the pipe member. In spite of this arrangement, the pipe end, adapted to the projection of the inwardly situated valve 14, is attached along the whole circumference to the block flange 11.

In the closed embodiment according to FIG. 1, the upper pipe portion can otherwise be additionally used as an inner support for such a spring controlled valve.

Figure 7:
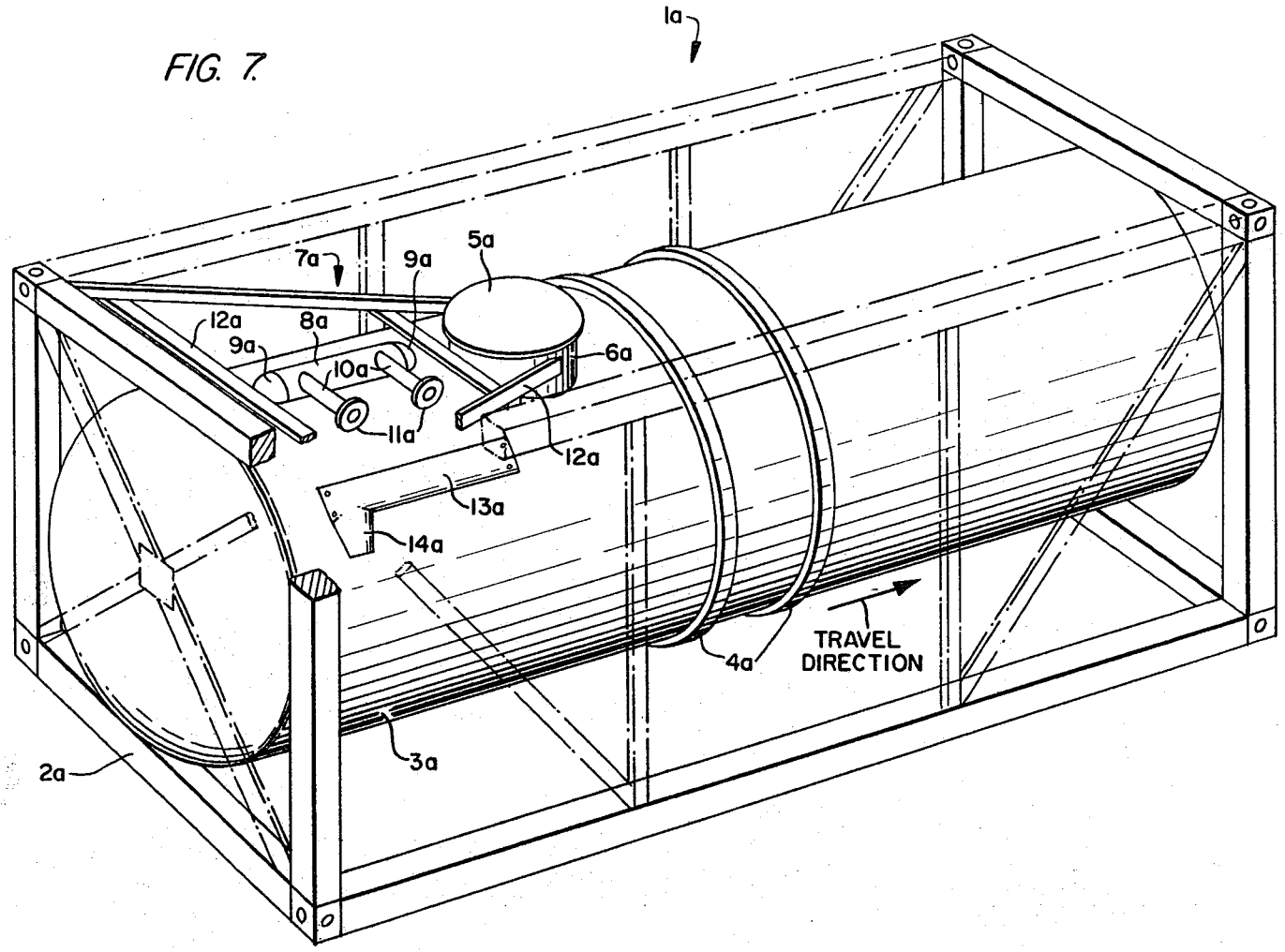
FIG. 7 shows a transport container made from cylindrical shells and held in a frame, constructed in accordance with a preferred embodiment of the present invention.

FIG. 7 shows a cylindrical transport container 1*a* for liquid, for gaseous media, or for loose material which is, in a manner known per se, supported in a frame 2*a* situated at the ends of the container. The cylindrical shells 3*a* are reinforced by reinforcing rings 4*a* to resist increased pressure from outside. In the top region of the transport container 1*a* is situated a manhole ring 6*a* covered by a disc cover 5*a*. This manhole ring 6*a* is very compact and capable of withstanding shear-off forces and is situated, in the direction of transport, in front of the pipe 8*a* according to the invention, which is so mounted at the top in the wall of the container parallel to its longitudinal axis that the upper area of its wall projects in the manner of a dome, above the wall of the container. In the embodiment shown in FIG. 7 the pipe 8*a* is closed at its both ends by segments 9*a* of a spherical shell. Pipe spouts 10*a* are situated spaced apart in horizontal or obliquely upwardly extending directions, and on these spouts are mounted various fixtures or dummy flanges 11*a*. A protective frame formed by connection members 12*a* which extends from the outer outlines of the manhole to the frame at the ends of the container can be included to further protect the pipe member and connections carried thereby. Preferred embodiments are also contemplated without a protective frame, wherein the position of the manhole assembly effectively protects the pipe member 8*a* and associated connections from being sheared off or damaged during use. In the illustrated embodiment of a liquid container both spouts extend to one side. If a blow-off of the liquid is envisaged it is sufficient to provide on this side a removable collector 13*a* provided with a discharge channel 14*a*. The protective frame mentioned earlier may be adapted to serve as a cover 7*a* preventing stealing or serving as a customs seal. Preferably also a working platform and a ladder (not illustrated) may be incorporated into the protective frame.

Figure 9:
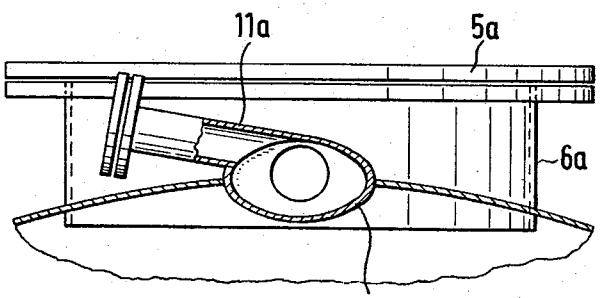
FIG. 9 is a cross-sectional view through a further embodiment of a pipe member constructed according to the present invention.
Figure 8:
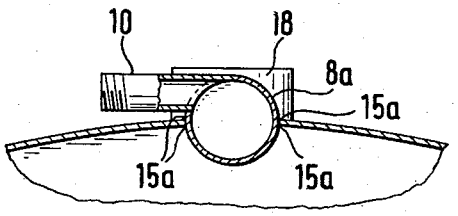
FIG. 8 is a cross-sectional view through a pipe member constructed according to the present invention and including a connection spout.
Figure 10A:
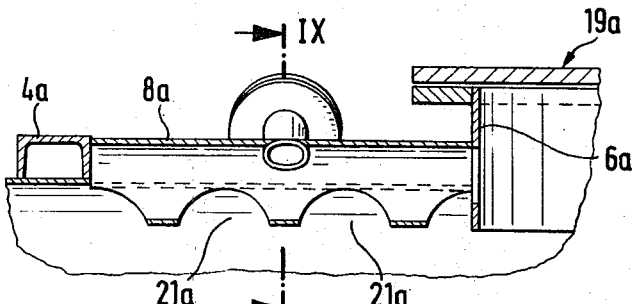
FIGS. 10 and 10*a* are partial longitudinal sectional views through an upper end section of respective transport containers, constructed in accordance with preferred embodiments of the present invention.
Figure 10:
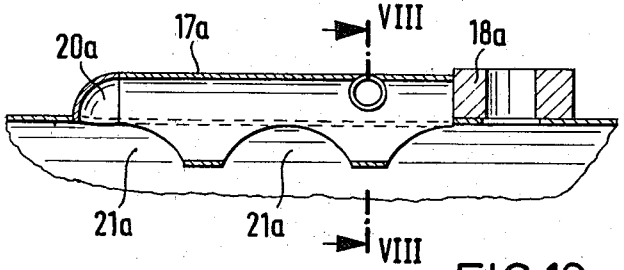

FIG. 8 shows the pipe 8*a*, dished in a dome-shaped manner according to FIG. 7 in cross-section. The pipe wall and the container wall are at 15*a* connected by e.g. a double fillet weld. The cross-section of the pipe 8*a* is circular. It can, however, be also elliptic or oval, as shown on the pipe 16*a* in FIG. 9, while the major axis of the ellipse extends horizontally. FIG. 10 shows in longitudinal section a pipe 17*a* which is at one end closed by a flange 18*a*, while at the other end, adjacent the manhole 19*a*, it is closed by a section 20*a* of a spherical shell. The part of the wall of the pipe which is situated inside the container is provided with openings 21*a* (FIG. 10). These openings 21*a* are in the illustrated embodiment circular. The wall bridges of the pipe 8*a* between the openings 21*a* serve to contain edge stresses caused by pressure inside the container. The wall bridges of the pipe 8*a* remaining between the openings 21*a* serve also to prevent splashing of the liquid in the container during transport. Due to the arrangement of the pipe according to the invention behind the manhole 19*a* in the direction of transport it is achieved that fixtures attached to the pipe receive the best possible protection from damage. According to one embodiment (FIG. 10*a*), the pipe may end at one end on the ring 6*a* of the manhole 19*a*, and one end of the pipe 8 may end on a transverse element E of the frame.

Figure 11:
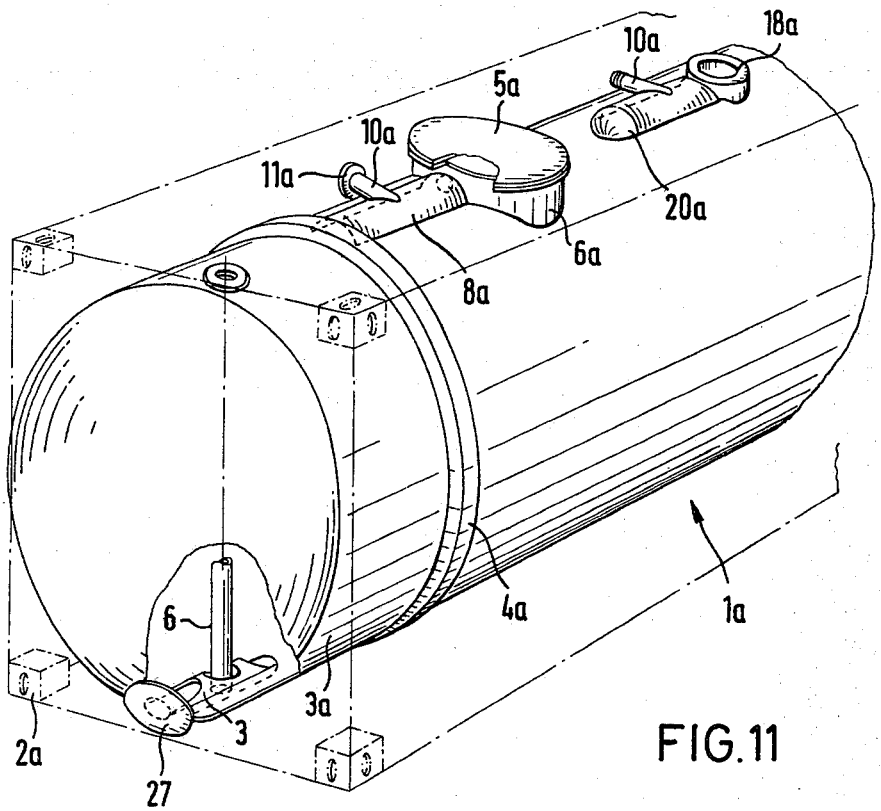
FIG. 11 is a longitudinal sectional view through parts of a transport container in accordance with the present invention including combination of inventive features.

FIG. 11 shows part of a container 1*a* which for the best possible utilization of space inside the container is provided with both top and bottom pipe members. Consequently, this is an especially height saving arrangement with fixtures on one top pipe 8*a* and also height saving provision of a pipe 3*a* in the bottom of the container.

As can be seen from the drawing, the pipe 8*a*, dished in a dome-shaped manner and extending over the container top, corresponds symmetrically to bottom sump forming pipe 3*a*.

Although a most advantageous practical embodiment of the present invention contemplates using pipe members welded into the top wall section (for accommodating a space and stress saving conection of fixtures) and into the bottom wall section (for forming a combination sump, riser holder, and attachment place for fixtures such as discharge opening means), it should be understood that the present invention also contemplates arrangements where only one of such pipe members is used.

The present invention also contemplates the method of manufacturing a transport container using pipe members formed separately of the container shell and equipped with appropriate connection points and openings as described herein. Subsequent to the formation of the pipe member assemblies, they are then welded into position in slots cutout of the container walls, with minimum adverse stress concentration on the container structure.

While I have shown and described several embodiments in accordance with the present invention, it is understood that the same is not limited thereto but is susceptible to numerous changes and modifications as known to those skilled in the art and I therefore do not wish to be limited to the details shown and described herein but intend to cover all such changes and modifications as are encompassed by the scope of the appended claims.

I claim:

1. Transport container comprising:

a large diameter cylindrical shell for holding material to be transported, said shell being formed by a cylindrical shell wall, at least one pipe member rigidly connected to the cylindrical shell wall, and connection means for fixtures such as material inlet and outlet means, relief pressure valve means, and the like, wherein the connection means are carried by the at least one pipe member, and wherein each of the at least one pipe members has a curved outer pipe wall disposed longitudinally astride said cylindrical shell wall with one of upper and lower circumferentially contiguous portions thereof being within said shell wall and the other of said upper and lower portions being outside of said shell, whereby stresses in the region of said rigid connection are reduced.

2. Transport container according to claim 1, wherein the maximum cross-sectional dimension of each of said at least one pipe members is substantially smaller than the diameter of said cylindrical shell.

3. Transport container according to claim 2, wherein the transition element consists of a segment of a spherical shell.

4. Transport container according to claim 1, wherein the maximum cross-sectional dimension of each of said at least one pipe members is smaller than one tenth of the diameter of said cylindrical shell.

5. Transport container according to claim 4, wherein each of said pipe members is welded at its outer periphery to the cylindrical shell wall.

6. Transport container according to claim 5, wherein each of said pipe members is disposed with about half of its cross-sectional height disposed outwardly of said cylindrical shell wall.

7. Transport container according to claim 5, wherein the cylindrical shell extends horizontally when in an in-use shipping position, and wherein one of said pipe members is disposed at the bottom of said cylindrical shell and serves as a sump region of said container.

8. Transport container according to claim 7, wherein a riser is provided for emptying the container under pressure, and wherein the lower end of said riser is guided and held in position by said pipe member disposed at the bottom of the cylindrical shell.

9. Transport container according to claim 8, wherein said pipe member disposed at the bottom of the cylindrical shell serves as a discharge spout for emptying the container by gravity, said pipe member ending in a connection flange for connecting a discharge valve or the like.

10. Transport container according to claim 8, wherein the maximum inside cross-sectional dimension of said pipe member disposed at the bottom of the cylindrical shell is equal to the maximum outside cross-sectional dimension of said riser.

11. Transport container according to claim 8, wherein a tapered collar is provided for guiding the bottom of the riser into an opening in said pipe member disposed at the bottom of the cylindrical shell.

12. Transport container according to claim 7, wherein said pipe member disposed at the bottom of the cylindrical shell serves as a discharge spout for emptying the container by gravity, said pipe member ending in a connection flange for connecting a discharge valve or the like.

13. Transport container according to claim 12, wherein said pipe member disposed at the bottom of said cylindrical shell has an upwardly open recess inside of said cylindrical shell adjacent the connection flange.

14. Transport container according to claim 12, wherein said connection flange is angularly inclined to conform to the surrounding portions of said cylindrical shell wall, and wherein said pipe member disposed at the bottom of said cylindrical shell has an oval pipe section, the flattening of which is adapted to the axial projection of the connection flange.

15. Transport container according to claim 12, wherein the portion of said pipe member adjacent the connection flange is formed as a support for an inwardly extending discharge valve.

16. Transport container according to claim 7, wherein a second of said pipe members is provided, disposed at the top of said cylindrical shell, said second pipe member having at least one connection opening which is accessible from the outside and which faces other than vertically upward.

17. Transport container according to claim 7, wherein said pipe member disposed at the bottom of said cylindrical shell merges into the bottom outer wall of the cylindrical shell by means of a transition element.

18. Transport container according to claim 17, wherein said transition element consists of a tongue-shaped wall portion of said pipe member disposed at the bottom of the cylindrical shell.

19. Transport container according to claim 7, wherein said bottom pipe member has between one half and two thirds of its cross-sectional height disposed inside said cylindrical shell.

20. Transport container according to claim 7, wherein said bottom pipe member extends transversely of the axial direction of said cylindrical shell.

21. Transport container according to claim 7, wherein said bottom pipe member extends parallel to the axial direction of said cylindrical shell.

22. Transport container according to claim 5, wherein the cylindrical shell extends horizontally when in an in-use shipping position, and wherein one of said pipe members is disposed at the top of said cylindrical shell and has at least one connection opening which is accessible from the outside and which faces other than vertically upward.

23. Transport container according to claim 22, wherein the top of said cylindrical shell includes a manhole assembly surrounded by a closing flange ring, and wherein one of the ends of the pipe member disposed at the top of said cylindrical shell is connected to said manhole assembly.

24. Transport container according to claim 23, wherein the portion of said pipe member disposed above the top of the cylindrical shell carries at least one pipe spout or closing flange for receiving fixtures or conduits, the axis of said at least one pipe spout or closing flange being other than the vertical axis of the container, and wherein the projection of the pipe spout or closing flange is below the projection of the manhole ring.

25. Transport container according to claim 23, further comprising protection frame elements for protecting the pipe member and associated connections and fixtures, said protection frame elements extending from the outermost upper and lateral points of the manhole assembly to an end frame or reinforcing ring of the container.

26. Transport container according to claim 22, wherein the top of said cylindrical shell has a vertical pipe spout or flange ring of a top connection, and wherein said pipe member at the top of said cylindrical shell ends on the flank of said vertical pipe spout or flange ring.

27. Transport container according to claim 22, wherein the portion of said pipe member disposed above the top of the cylindrical shell carries at least one pipe spout or closing flange for receiving fixtures or conduits, the axis of said at least one pipe spout or closing flange being other than the vertical axis of the container.

28. Transport container according to claim 22, wherein the lower area of the pipe member disposed inside the cylindrical shell has at least two, preferably circular openings separated by bridge parts formed of the remaining pipe wall sections.

29. Transport container according to claim 28, wherein said openings are arranged in the bottom of the top pipe member.

30. Transport container according to claim 22, wherein said top pipe member has between one half and two thirds of its cross-sectional height disposed above and outside said cylindrical shell.

31. Transport container according to claim 22, wherein said top pipe member extends transversely of the axial direction of said cylindrical shell.

32. Transport container according to claim 22, wherein said top pipe member extends parallel to the axial direction of said cylindrical shell.

33. Transport container according to claim 5, wherein a total of two of said pipe members are provided, on pipe member at the top and one pipe member at the bottom of a horizontally extending cylindrical shell.

34. Transport container according to claim 33, wherein said cylindrical shell has an outside diameter of between six feet and nine feet and each of said pipe members has a maximum cross-sectional dimension of between two and five inches.

35. Transport container according to claim 34, further comprising a frame having corner fittings for accommodating stacking and loading of said container, and wherein said cylindrical shell and said pipe members are contained within the vertical projection of said frame.

36. Transport container according to claim 5, wherein said cylindrical shell has an outside diameter of between six feet and eight feet and each of said pipe members has a maximum cross-sectional dimension of between two and five inches.

37. Transport container according to claim 1, wherein at least one of said at least one pipe members has a circular cross-section.

38. Transport container according to claim 1, wherein at least one of said at least one pipe members has an elliptic or oval cross-section, the major axis of which is horizontal and transverse to the longitudinal axis of the cylindrical shell.

39. Transport container according to claim 1, wherein each of said pipe members merges into the outer wall of the cylindrical shell by way of a spherical shell part.

40. Transort container according to claim 1, wherein said cylindrical shell is surrounded by at least one reinforcing ring. and wherein at least one of said pipe members ends at one of said reinforcing rings.

41. Transport container according to claim 1, wherein the material and wall thickness of said pipe member is the same as the material and wall thickness of the cylindrical shell.

* * * * *